US009923322B2

(12) United States Patent
Tang et al.

(10) Patent No.: US 9,923,322 B2
(45) Date of Patent: Mar. 20, 2018

(54) STACKING CONNECTOR AND STACKING CONNECTOR ASSEMBLY HAVING IMPROVED MULTIPORT ARRANGEMENT

(71) Applicant: FOXCONN INTERCONNECT TECHNOLOGY LIMITED, Grand Cayman (KY)

(72) Inventors: Zhi-hui Tang, Kunshan (CN); Jun-Hua Hu, Kunshan (CN); Chih-Ching Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/279,816

(22) Filed: Sep. 29, 2016

(65) Prior Publication Data

US 2017/0093103 A1 Mar. 30, 2017

(30) Foreign Application Priority Data

Sep. 30, 2015 (CN) ..... 2015 1 0635844

(51) Int. Cl.

| | |
|---|---|
| ***H01R 27/02*** | (2006.01) |
| ***H01R 12/71*** | (2011.01) |
| ***H01R 24/60*** | (2011.01) |
| *H01R 13/659* | (2011.01) |
| *H01R 24/64* | (2011.01) |
| *H01R 107/00* | (2006.01) |
| *H01R 12/72* | (2011.01) |

(52) U.S. Cl.

CPC ..... *H01R 27/02* (2013.01); *H01R 12/716* (2013.01); *H01R 24/60* (2013.01); *H01R 12/722* (2013.01); *H01R 13/659* (2013.01); *H01R 24/64* (2013.01); *H01R 2107/00* (2013.01)

(58) Field of Classification Search

CPC .... H01R 27/02; H01R 12/716; H01R 13/659; H01R 13/6586; H01R 13/6587; H01R 24/60; H01R 24/64

USPC ..... 439/541.5, 607.23, 607.24, 607.25, 439/607.27, 607.35, 607.55, 701

See application file for complete search history.

(56) References Cited

U.S. PATENT DOCUMENTS

| | | | | |
|---|---|---|---|---|
| 6,162,089 | A | 12/2000 | Costello et al. | |
| 6,835,092 | B2 * | 12/2004 | Wan | H01R 13/6658 439/541.5 |
| 7,556,528 | B1 * | 7/2009 | Ju | H01R 24/60 439/541.5 |

(Continued)

FOREIGN PATENT DOCUMENTS

| | | |
|---|---|---|
| CN | 2624466 | 7/2004 |
| CN | 2717055 | 8/2005 |

(Continued)

*Primary Examiner* — Renee S Luebke
*Assistant Examiner* — Paul Baillargeon
(74) *Attorney, Agent, or Firm* — Wei Te Chung; Ming Chieh Chang

(57) ABSTRACT

A stacking connector including: a first port for receiving an RJ-45 plug along a front-to-back direction; a second port below the first port for receiving a USB Type-A plug, the second port and the first port being formed on a same insulative housing; and a receiving room formed below the second port for receiving an external USB Type-C connector, the receiving room has an opening running through a bottom surface of the insulative housing.

17 Claims, 7 Drawing Sheets

(56) References Cited

U.S. PATENT DOCUMENTS

| | | | | |
|---|---|---|---|---|
| 7,762,840 | B2 * | 7/2010 | Hamner | H01R 13/65802 439/541.5 |
| 7,967,631 | B2 * | 6/2011 | Wang | H01R 13/502 439/541.5 |
| 8,721,364 | B2 * | 5/2014 | Lai | H01R 27/02 439/540.1 |
| 2009/0298338 | A1 * | 12/2009 | Zhang | H01R 23/6873 439/607.28 |
| 2014/0315406 | A1 * | 10/2014 | Pocrass | H01R 27/02 439/217 |
| 2016/0126677 | A1 * | 5/2016 | Yu | H01R 13/6474 439/607.23 |

FOREIGN PATENT DOCUMENTS

| | | |
|---|---|---|
| CN | 201075493 | 6/2008 |
| CN | 204144593 | 2/2015 |
| TW | I283503 | 7/2007 |

* cited by examiner

STACKING CONNECTOR AND STACKING CONNECTOR ASSEMBLY HAVING IMPROVED MULTIPORT ARRANGEMENT

BACKGROUND OF THE INVENTION

1. Field of the Invention

The present invention relates to a stacking connector, and in particular to a stacking connector having three connectors which are shielded from each other.

2. Description of Related Art

U.S. Pat. No. 7,762,840, issued on Jul. 27, 2010, discloses an upper connector stacked above a lower connector. The upper connector has a housing that defines an open bottomed cavity defining a cavity envelope. The lower connector is separately mountable to a circuit board and has an outer envelope adapted for fitting in the cavity envelope of the upper connector housing.

U.S. Pat. No. 6,162,089, issued on Dec. 19, 2000, discloses a stacking connector mounted on a mainboard. The stacking connector includes one RJ-45 port and two USB 2.0 ports. The USB 2.0 port includes a tongue portion, a plurality of terminals being insert molded with the tongue portion, and a shielding shell surrounding the tongue portion. An upper plate section of the shielding shell includes a pair of spring tabs which form a hole that leaks electromagnetic ray into the RJ-45 port.

China Patent No. 204144593, issued on Feb. 4, 2015, discloses an individual USB 3.1 Type-C connector including an integrated metal shell. However, when motherboard manufacturers upgrade a stacking connector with one RJ-45 connector and two USB connectors, they will not provide a stacking connector having two USB 3.1 Type-C connectors because the USB 3.1 Type-C connector in not compatible with a USB 2.0 port or a USB 3.0 port. In order to allow mobile and tablet computers to use USB 3.1 Type-C port, the mobile and tablet computers need to be provided with a USB 3.1 Type-C connector.

A stacking connector having an improved configuration is desired.

SUMMARY OF THE INVENTION

Accordingly, an object of the present invention is to provide a stacking connector that efficiently arranges multiports.

In order to achieve the object set forth, the invention provides a stacking connector comprising: a first port for receiving an RJ-45 plug along a front-to-back direction; a second port below the first port for receiving a USB Type-A plug, the second port and the first port being formed on a same insulative housing; and a receiving room formed below the second port for receiving an external USB Type-C connector, the receiving room has an opening running through a bottom surface of the insulative housing Other objects, advantages and novel features of the invention will become more apparent from the following detailed description when taken in conjunction with the accompanying drawings.

DETAILED DESCRIPTION OF THE PREFERRED EMBODIMENT

Figure 1:
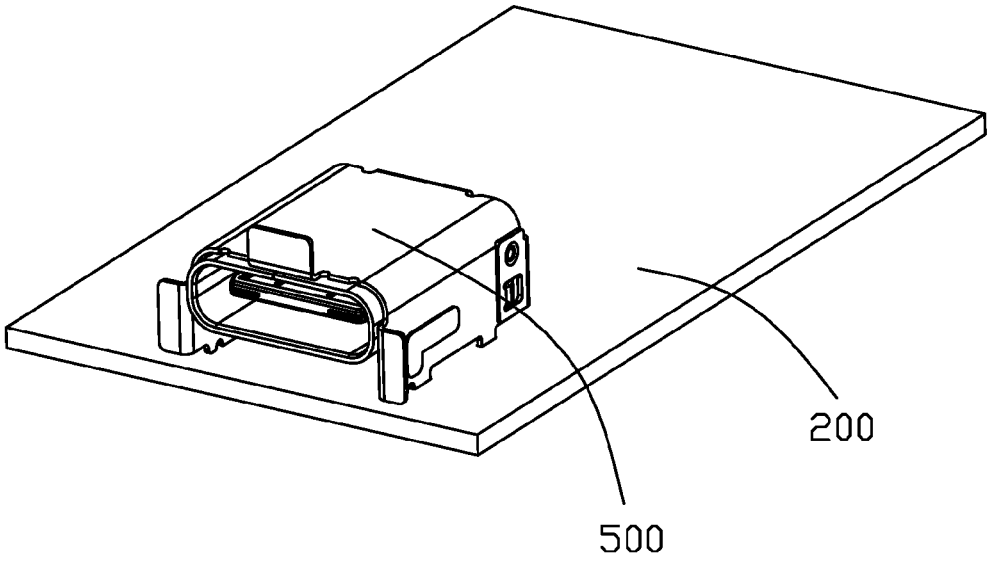
FIG. 1 is a perspective view of a USB Type-C connector pre-assembled upon a mainboard.
Figure 2:
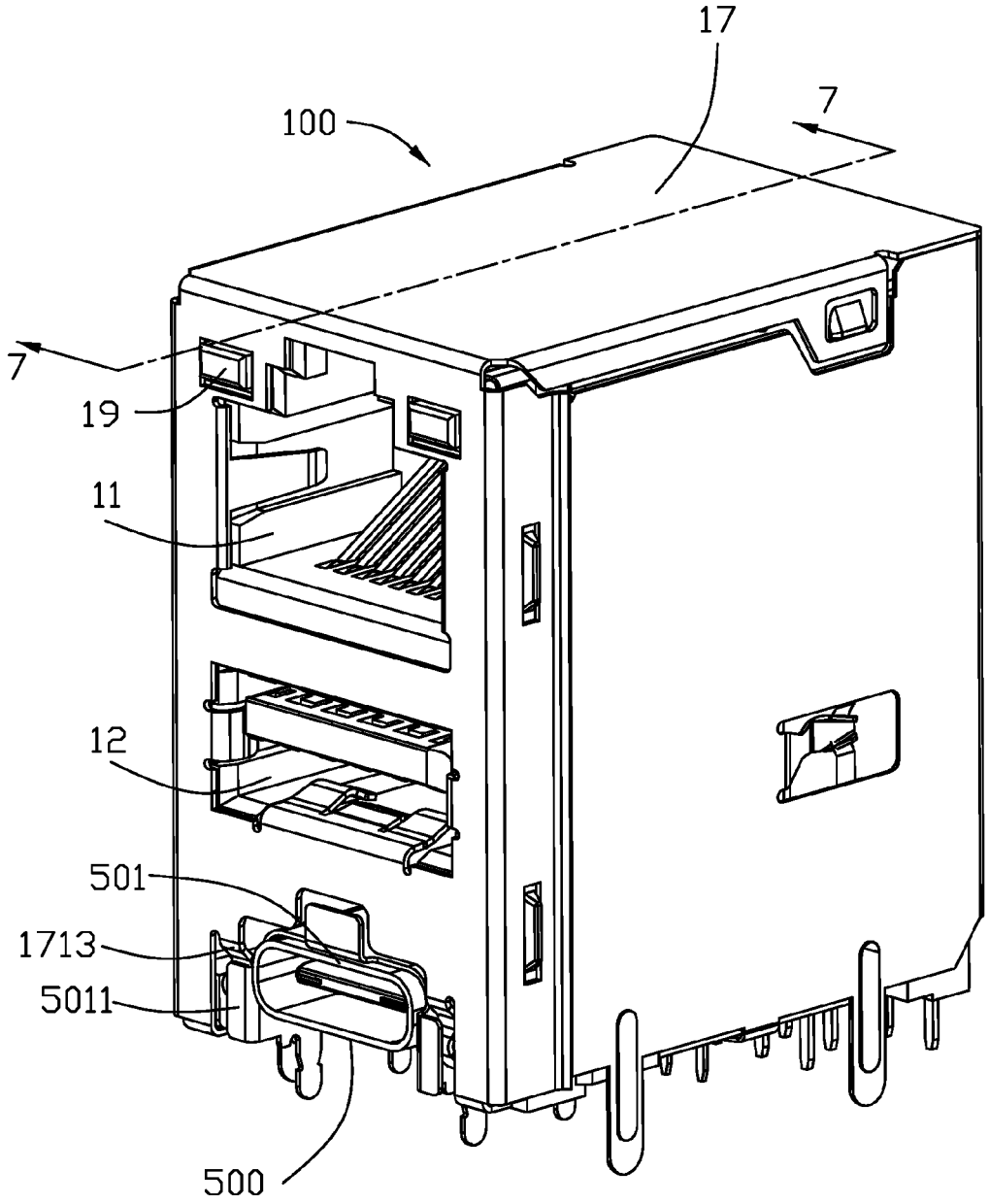
FIG. 2 is a perspective view of a stacking connector, which set on the USB 3.1 type C connector.
Figure 3:
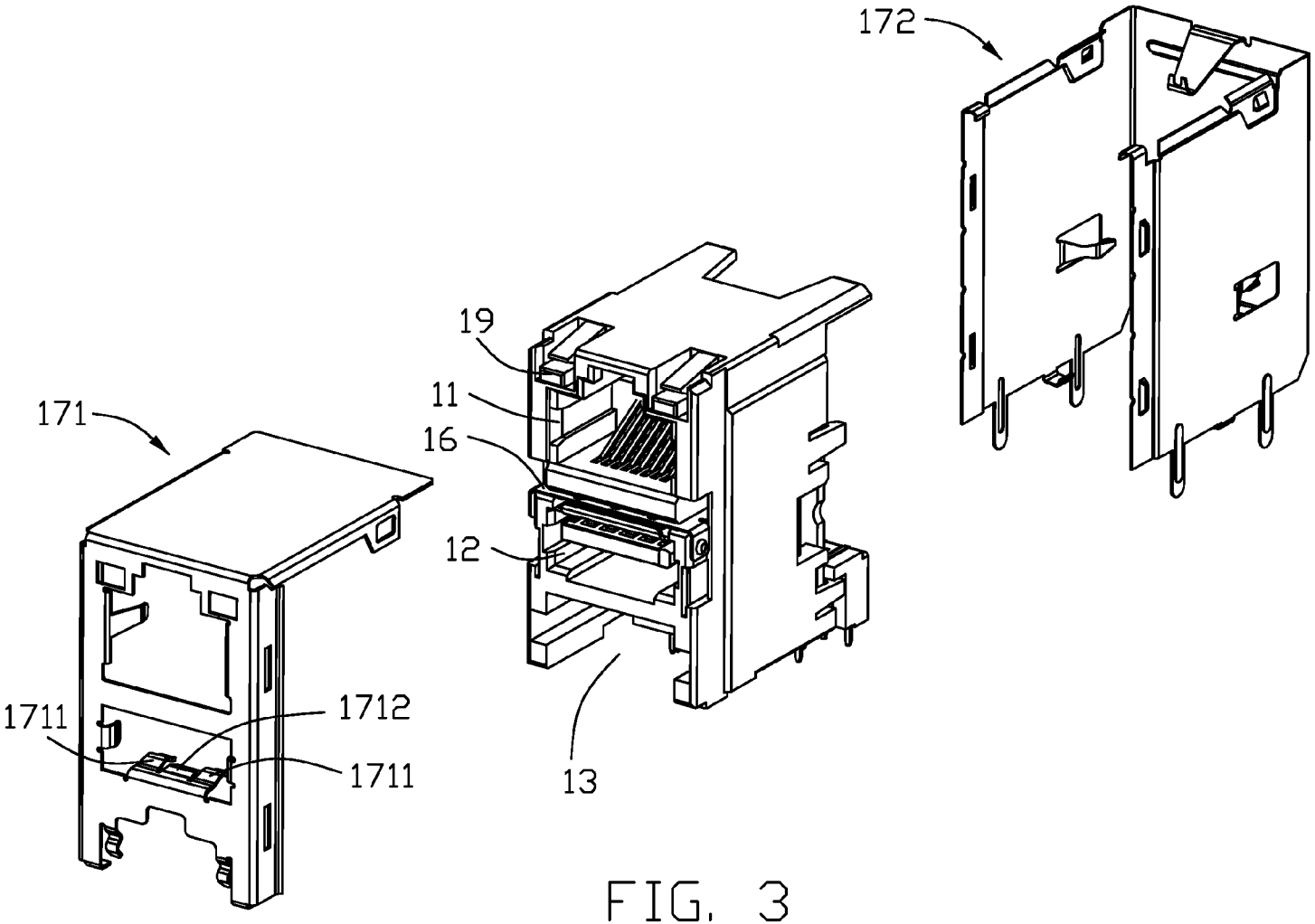
FIG. 3 is an exploded view of the stacking connector shown in FIG. 2.

Reference will now be made in detail to the preferred embodiment of the present invention.

Referring to FIGS. 1-7, a stacking connector assembly comprises a mainboard 200 and a stacking connector 100 mounted on said mainboard 200, said mainboard 200 pre-set a USB receptacle connector 500. The stacking connector 100 comprises a first port 11, a second port 12 located below the first port 11, and a receiving room 13 opening downward which located below the second port 12. The first port is used for inserting with a network plug (not shown) in a front-to-back direction, in other words, the first port 11 is a RJ-45 port. The second port 12 is used for inserting with a USB plug (not shown). Preferably, the second port 12 is a USB 3.1 Type-A port, but also can be a USB 3.0 or USB 2.0 Type-A port. For convenience, the following example only describes the second port 12 is the USB 2.0 Type-A port.

The USB receptacle connector 500 which pre-set on the mainboard 200 is a USB 3.1 Type-C connector. When the stacking connector 100 mounted on the mainboard 200, the USB receptacle connector 500 received in the receiving room 13. This setting overcomes the technical problem of the USB Type-C connector and the USB Type-A connector can not stack together due to the different sizes. The stacking connector 100 and the USB 3.1 Type-C connector are manufactured separately, the USB 3.1 Type-C connector is mounted on the mainboard 200, and then the stacking connector 100 mounted above the USB 3.1 Type-C. It is convenient to manufacture and assemble the stacking connector 100 and the USB 3.1 Type-C connector.

Figure 5:
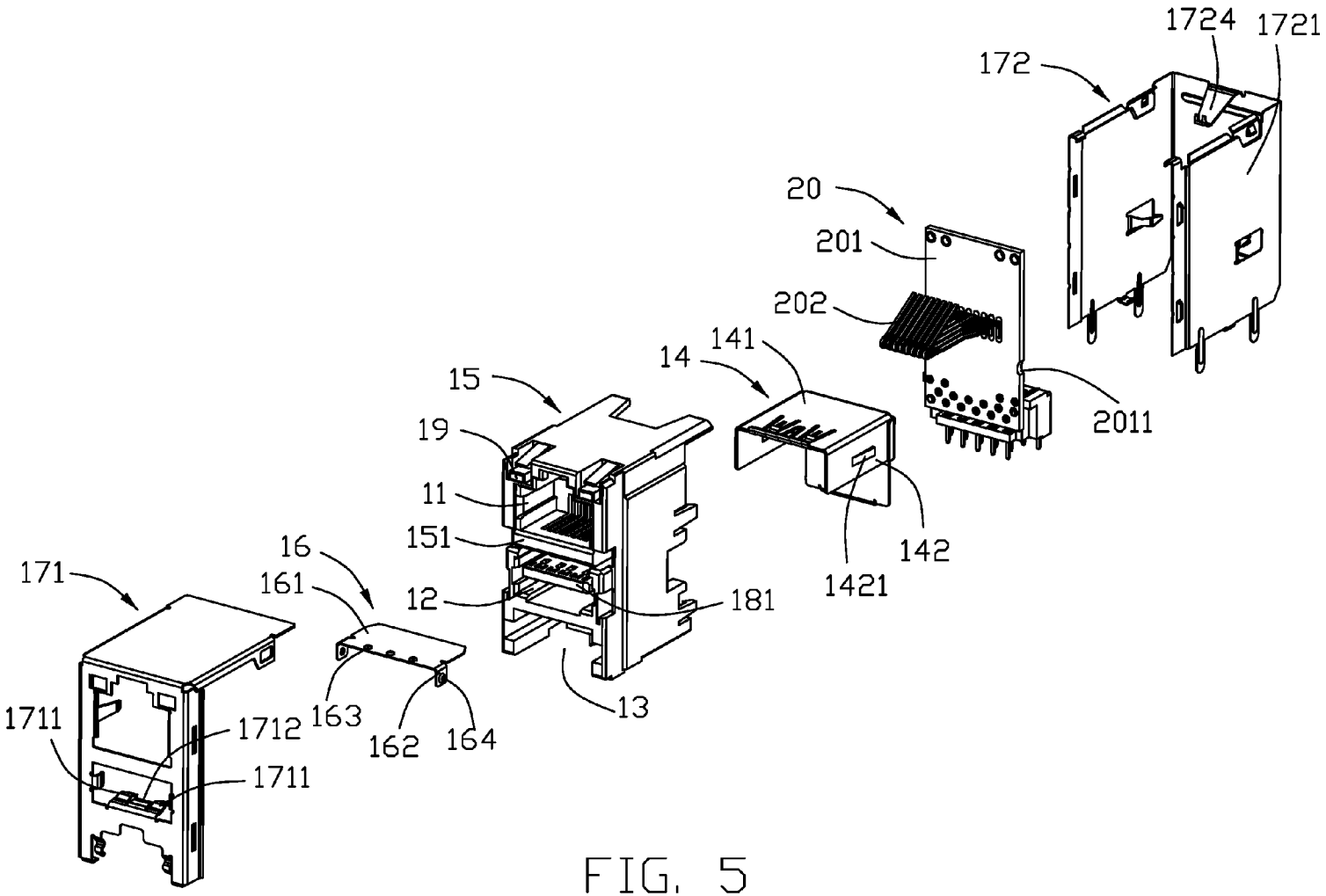
FIG. 5 is a further exploded view of the stacking connector shown in FIG. 3.
Figure 6:
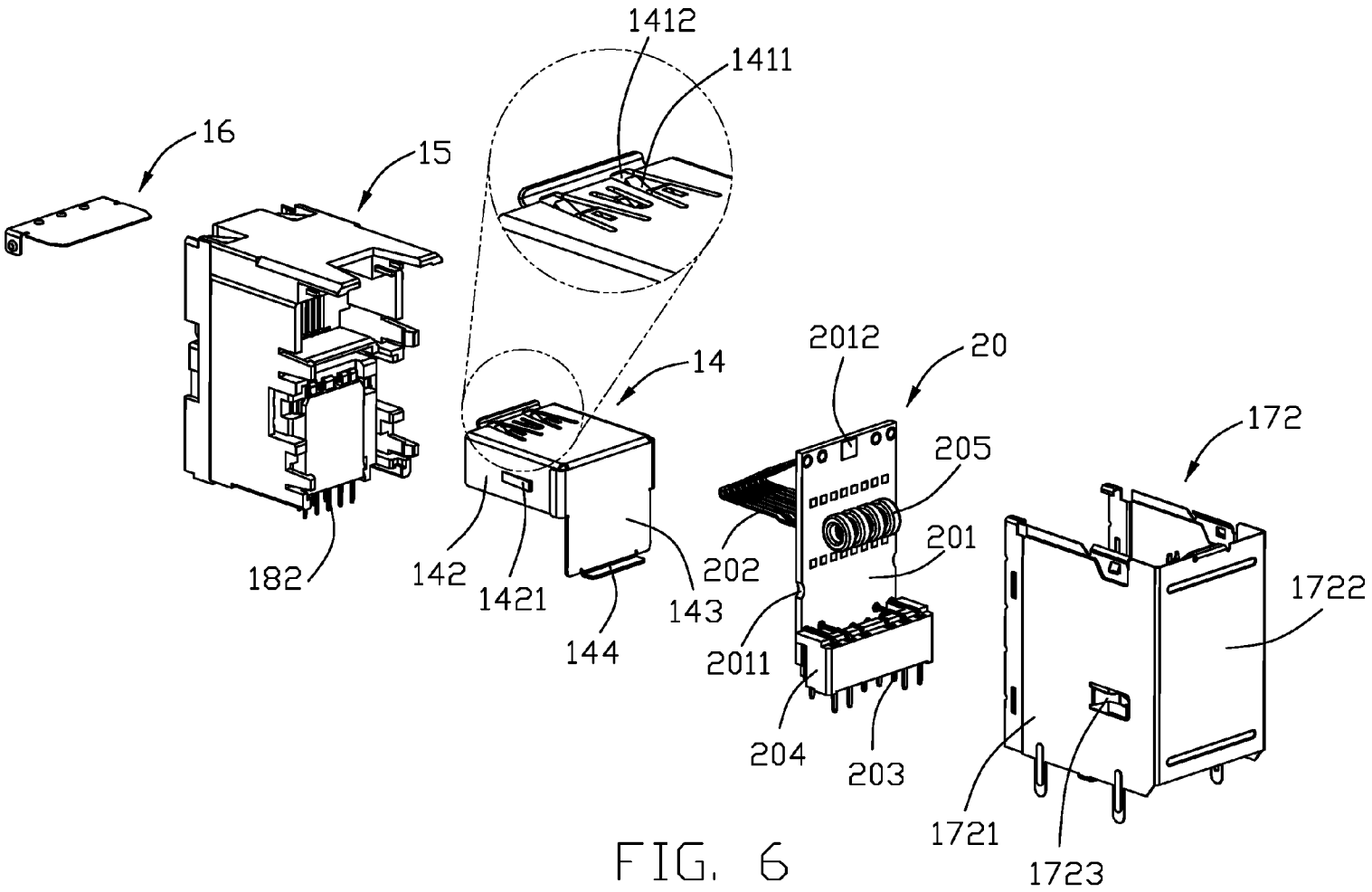
FIG. 6 is another exploded view of the stacking connector shown in FIG. 5.
Figure 7:
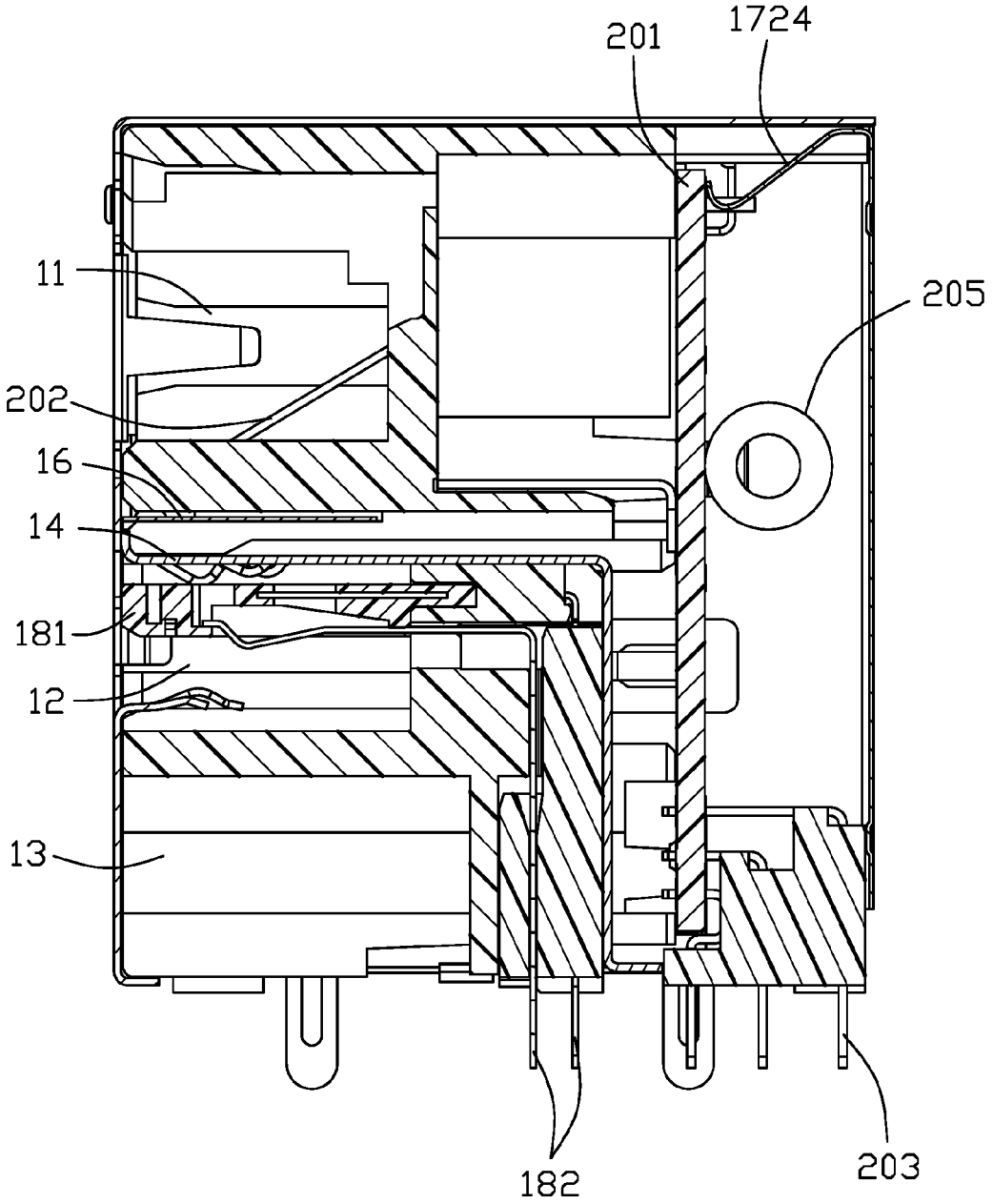
FIG. 7 is a cross-sectional view of the stacking connector seen in FIG. 2, taken along line 7-7.

Referring to FIGS. 5-6, the stacking connector 100 further comprises a shielding member 14 which can shield signal interference between the first port 11 and the second port 12. The shielding member 14 comprises an upper plate section 141, a pair of side plate sections 142 extends downwardly from opposite sides of the upper plate section 141, and a rear plate section 143 connected with the upper plate section 141 and the pair of side plate sections 142. An upper side, a left side and a right side of the second port 12 are surrounded by the upper plate section 141 and the pair of side plate sections 142 respectively. The side plate section 142 includes a protruding portion 1421 used for the shielding member 14 retaining with the second port 12 stably. We should note that a bottom side of the second port 12 is not surrounded by the shielding member 14. Due to the USB 3.1 Type-C connector which received in the receiving room 13 having a shielding case by its self, the signal interference between the USB 3.1 Type-A connector and the USB 3.1 Type-C connector is shield by the shielding case of the USB 3.1 Type-C connector. Thus, the shielding member 14 should not provide a bottom plate section.

The upper plate section 141 comprises a pair of spring tabs 1411 stamping in a pair of holes 1412 respectively, said spring tabs 1411 is used for locking with a USB plug. The stacking connector 100 comprises a shielding plate 16 located between the first port 11 and the shielding member, the shielding plate 16 is used for shielding the signal leaked out from the hole 1412 and reducing the signal interference between the first port 11 and the second port 12.

The rear plate section 142 sets in a vertical state and has a spacing section 144 extending backward in its bottom surface. The stacking connector 100 comprises a RJ-45 transmission module 20, said RJ-45 transmission module 20 includes an inner circuit board 201 sets in a vertical state in an up-to-down direction, eight network mating terminals 202 each connecting the inner circuit board 201 in a front side, a number of mainboard connecting terminals 203 each connecting the inner circuit board 201 in a rear side, and a insulative bracket 204 which is used for holding the mainboard connecting terminals 203. A plurality of transformers 205 mounted on the rear side of the inner circuit board 201 which locates above the mainboard connecting terminals 203, and a plurality of common mode chokes (not shown) mounted on the front side of the inner circuit board 201 which locates under the network mating terminals 202. The spacing section 144 is used for limiting the installation location of the RJ-45 transmission module 20 in the front-to-back direction, and thus, the common mode chokes (not shown) have enough pre-set receiving space.

The network mating terminals 202 connected to the mainboard connecting terminals 203 through the inner circuit board 201, the transformer 205 and the common mode chokes (not shown), the transformer 205 and the common mode chokes is used for filtering irrelevant signals of the network signal. The transformer 205 can be an isolated transformer or self coupling transformer. A form of the transformer 205 can be a magnetic ring winding with coil, a surface-mounted transformer or a multilayer transformer. The front side of the inner circuit board 201 further comprises a coupling capacitors (not shown) series between the network mating terminals 202 and the mainboard connecting terminals 203. The inner circuit board 201 can set up Bob-smith terminal (not shown) suitable for grounding. The Bob-smith terminal (not shown) comprises a resistor (not shown) and the capacitor (not shown), the resistor (not shown), the capacitor (not shown) and the coupling capacitor are all surface-mounted structure.

Figure 4:
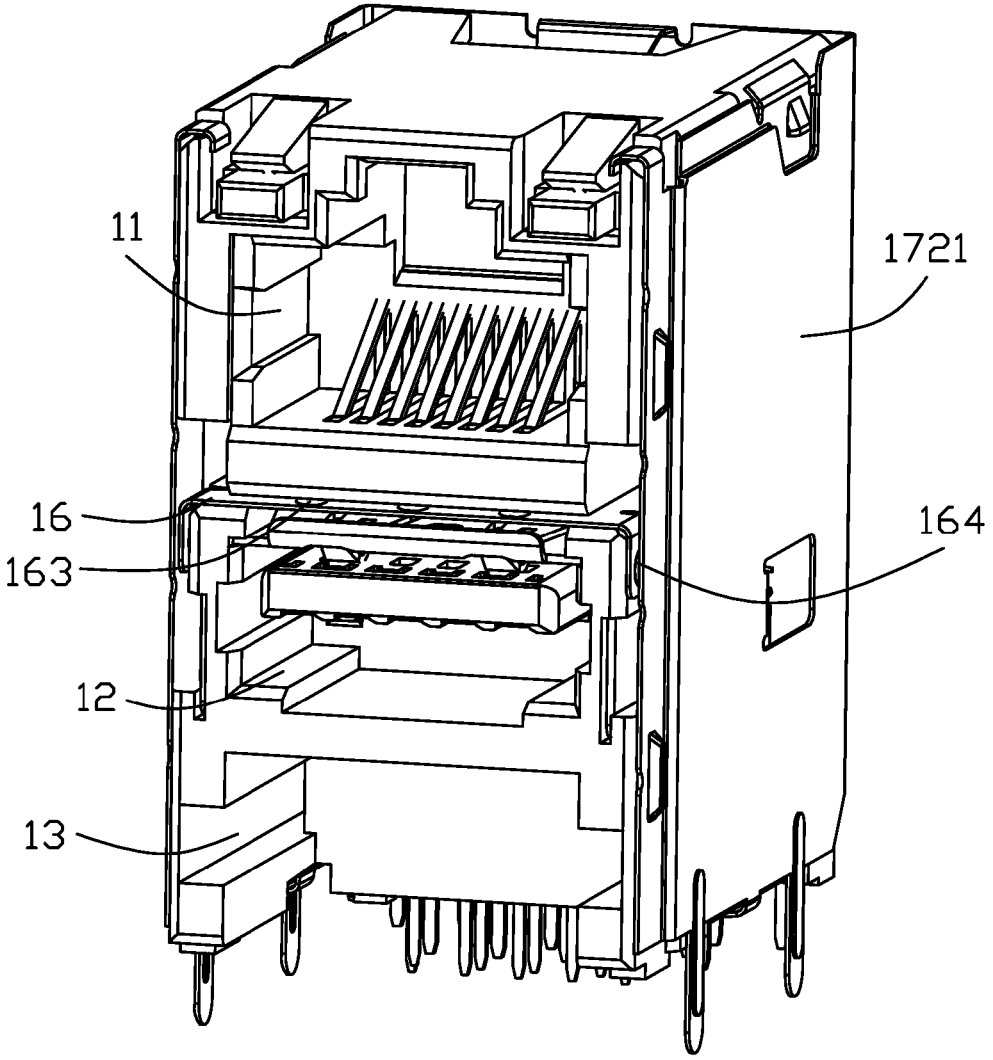
FIG. 4 is a perspective view of the stacking connector shown in FIG. 2, which exclude a front shell.

Referring to FIGS. 4-5, the stacking connector 100 comprises an insulative housing 15, the insulative housing 15 includes an interval wall 151 setting between the first port 11 and the second port 12. The shielding plate 16 located between the interval wall 151 and the shielding member 14, the shielding plate 16 could take out forward from the insulative housing 15 in the front-to-back direction. The first port 11 and the second port 12 are consist of the same insulative housing 15, of course the USB 3.1 Type-A connector also can be made solely which have a receiving room 13 for receiving the USB 3.1 Type-C connector, and then the USB 3.1 Type-A connector is assembled to the insulative housing of the RJ-45. The first port 11 and the second port 12 consist of the same insulative housing 15 means the RJ-45 connector and the USB 3.1 Type-A connector have the same insulative housing 15, and the receiving room 13 also formed by the insulative housing 15. Thus, that can reduce the processing assembly processes and reduce production costs.

The shielding plate 16 comprises a horizontal section 161 extending in the front-to-back direction and a pair of side arm sections 162 extending downwardly form opposite sides of the horizontal section 161 respectively. The horizontal section 161 comprises at least one first bump 163 cooperating with the interval wall 151 for enhancing the binding force between the horizontal section 161 and the insulative housing 15.

Referring to FIGS. 5-6 and FIG. 1, the stacking connector 100 further comprises a metal shell 17 covering the insulative housing 15, the metal shell 17 comprises a front shell 171 and a rear shell 172 locking with the front shell 171. The front shell 171 comprises three spring sheets, said three spring sheets includes two locking sheets 1711 locked with the USB plug and one enhancing sheet 1712 located between the two locking sheets 1711 increasing the retaining force between the front shell 171 and the USB plug. The rear shell 172 comprises two opposite side sheets 1721 and a rear sheet 1722 located between the two side sheets 1721 connecting with said two side sheets 1721. The inner circuit board 201 includes two opposite electric notches 2011, each side sheet 1721 includes a grounding section 1723 that project inward to connect with the electric notches 2011. The inner circuit board 201 includes a electric pad 2012 located on the rear side, the rear sheet 1722 comprises a rear grounding section 1724 extending inward to connect with the electric pad 2012. The front shell 171 further comprises a pair of spring arms 1713 extending into the receiving room 13, the USB receptacle connector 500 comprises a shell 501 having a pair of tabs 5011 connecting with the spring arm 1713. Said spring arm 1713 located inside of the tab 5011 and elastic abuts on the tab 5011 for grounding reliably.

Referring to FIGS. 4-7, the side arm section 162 of the shielding plate 16 comprises a second bump 164 cooperating with the side sheet 1721 of the rear shell 172 for earth connecting. The USB 3.1 Type-C connector which inserted in the second port 12 comprising a tongue portion 181 and nine terminals 182 received in the tongue portion by injection molding. The stacking connector 100 further comprises a LED which used for indicating the communication status of the RJ-45 connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A stacking connector comprising:

a first port for receiving an RJ-45 plug along a front-to-back direction;

a second port below the first port for receiving a USB Type-A plug, the second port and the first port being formed on a same insulative housing;

a receiving room formed below the second port for receiving an external USB Type-C connector, the receiving room has an opening running through a bottom surface of the insulative housing; and a shielding member located between the first port and the second port; wherein the second port has an upper side, a bottom side, and two opposite sides, the shielding member surrounding the upper side and the two opposite sides; and the shielding member has an upper plate section, a pair of side plate sections extending downwardly from opposite sides of the upper plate section, and a rear plate section connecting with the upper plate section and the pair of side plate sections, the upper plate section having a pair of spring tabs.

2. The stacking connector as claimed in claim 1, further comprising a shielding plate located between the first port and the shielding member.

3. The stacking connector as claimed in claim 2, wherein the insulative housing includes an interval wall between the first port and the second port, the shielding plate retained between the interval wall and the shielding member, the shielding plate being forwardly removable from the insulative housing.

4. The stacking connector as claimed in claim 3, wherein the shielding plate comprises a horizontal section extending in the front-to-back and a pair of side arm sections extending downwardly from two opposite sides of the horizontal section, respectively.

5. The stacking connector as claimed in claim 4, further comprising a metal shell covering the insulative housing, the metal shell including three spring sheets protruding into the second port, the three spring sheets defining two locking sheets locked with the USB plug and an enhancing sheet, each side arm section including a bump cooperating with the metal shell.

6. A stacking connector assembly comprising:

a stacking connector comprising an insulative housing, said insulative housing having a first mating slot, a second mating slot, a receiving room defining a bottom opening, an interval wall between the first mating slot and the second mating slot, and a tongue portion located in the second mating slot;

a plurality of first terminals received in the insulative housing and protruding into the first mating slot for forming a first port to cooperate with an RJ-45 plug;

a plurality of second terminals retained in the tongue portion and exposed in the second mating slot for forming a second port to cooperate with a USB Type-A plug;

a mainboard including a USB Type-C connector, the USB Type-C connector received in the receiving room in an up-to-down direction;

a shielding member for locking with the USB Type-A plug, the shielding member surrounding an upper side, a rear side, and two opposite sides of the second port; and a shielding plate located between the first port and the shielding member in the up-to-down direction.

7. The stacking connector assembly as claimed in claim 6, wherein the shielding member has a rear plate section shielding the rear side of the second port, the rear plate section set in a vertical state and having a spacing section extending backward.

8. An electrical connector assembly comprising:

a monolithic insulative housing forming an upper mating port and a lower mating port separated from each other in a vertical direction, both said upper mating port and said lower mating port forwardly communicating with an exterior in a front-to-back direction perpendicular to said vertical direction;

a plurality of upper terminals disposed in the housing and extending into the upper mating port;

a plurality of lower terminals disposed in the housing and extending into the lower mating port; and a metallic horizontally extending shielding plate forwardly inserted into the housing from a rear side of the housing and electrically isolating the upper mating port and the lower mating port; wherein said shielding plate directly communicatively faces said lower mating port in the vertical direction, and is equipped with a spring tab deflectable in the vertical direction for retaining a complementary plug received within said lower mating port.

9. The electrical connector assembly as claimed in claim 8, further including a metallic outer shield enclosing the housing, wherein said outer shield includes a front plate covering a front face of the housing and equipped with another spring tab extending into said lower mating port opposite to said spring tab in the vertical direction.

10. The electrical connector assembly as claimed in claim 9, wherein said housing from a receiving room under the lower mating port to receive an external connector directly pre-assembled upon a printed circuit board on which the housing is seated.

11. The electrical connector assembly as claimed in claim 10, wherein said outer shield forms a spring tang abutting against a metallic shell of said external connector.

12. The electrical connector assembly as claimed in claim 11, wherein said spring tang presses the shell of the external connector in the front-to-back direction.

13. The electrical connector assembly as claimed in claim 12, wherein said spring tang is located behind the shell of the external connector in the front-to-back direction.

14. The electrical connector assembly as claimed in claim 8, wherein a pair of metallic side plates are unitarily formed on two lateral sides of the shielding plate so as to form a U-shaped combined structure in a front view, each of said two side plates being equipped with a locking tang to retain said U-shaped combine structure to the housing.

15. The electrical connector assembly as claimed in claim 8, further including another shielding plate detachably attached to the housing along the front-to-back direction and intimately located beside the shielding plate in the vertical direction opposite to said lower mating port for completing a shielding effect which is jeopardized by an opening due to formation of the spring tab.

16. The electrical connector assembly as claimed in claim 8, wherein a vertical plate is unitarily linked at a rear edge of said shielding plate to form an L-shaped combined structure in a side view, and said vertical plate electrically isolates, along the front-to-back direction, the lower terminals and a vertically extending printed circuit board which is electrically and mechanically connected to the upper terminals.

17. The electrical connector assembly as claimed in claim 16, wherein said printed circuit board is equipped with a plurality of connecting terminals around a bottom edge, said connecting terminals being separated from tails of the lower terminals in the front-to-back direction by said vertical printed circuit board.

* * * * *